US005086723A

United States Patent [19]

Goldbach et al.

[11] Patent Number: 5,086,723

[45] Date of Patent: Feb. 11, 1992

[54] DOUBLE-HULLED VESSEL CONSTRUCTION HAVING VERTICAL DOUBLE-WALLED LONGITUDINAL BULKHEAD

[75] Inventors: Robert D. Goldbach, Milford, Pa.; Joseph Cuneo, Hastings on the Hudson, N.Y.

[73] Assignees: Metro Machine Corporation, Norfolk, Va.; Marinex International, Inc., Hoboken, N.J.

[21] Appl. No.: 713,990

[22] Filed: Jun. 12, 1991

[51] Int. Cl.[5] ..... B63B 3/68

[52] U.S. Cl. ..... 114/78; 114/74 A

[58] Field of Search ..... 114/65 R, 74 A, 77 R, 114/78, 355

[56] References Cited

U.S. PATENT DOCUMENTS

| | | | |
|---|---|---|---|
| 2,413,821 | 1/1947 | Frear | 114/78 |
| 3,011,252 | 12/1961 | Svensson | 29/429 |
| 3,447,503 | 6/1969 | Myers | 114/77 |
| 3,487,807 | 1/1970 | Van Der Hoeven | 114/77 |
| 3,656,680 | 4/1972 | Nomura | 228/44 |
| 3,698,344 | 10/1972 | Maeda | 114/77 R |
| 3,703,153 | 11/1972 | Maeda | 114/77 R |
| 3,704,822 | 12/1972 | Nomura | 228/25 |
| 3,753,413 | 8/1973 | Ichikawa et al. | 114/65 |
| 3,872,815 | 3/1975 | Kawai et al. | 114/65 R |
| 3,875,887 | 4/1975 | Fittrip et al. | 114/77 R |
| 3,886,883 | 6/1975 | Odaka | 114/65 R |
| 4,003,326 | 1/1977 | Horii et al. | 114/65 R |
| 4,038,799 | 8/1977 | Shanks | 114/78 |
| 4,182,254 | 1/1980 | Secord | 114/74 A |
| 4,267,789 | 5/1981 | Ivanov et al. | 114/65 R |
| 4,341,175 | 7/1982 | Ivanov | 114/65 R |
| 4,476,797 | 10/1984 | Ivanov et al. | 114/65 R |
| 4,548,154 | 10/1985 | Murata et al. | 114/355 |
| 4,573,422 | 3/1986 | Murata et al. | 114/65 |
| 4,638,754 | 1/1987 | Tornay | 114/79 R |
| 4,660,491 | 4/1987 | Murata et al. | 114/65 |
| 4,674,430 | 6/1987 | Murata et al. | 114/355 |

OTHER PUBLICATIONS

"Great Lakes Ore Transportation System" (description of the vessel and construction method which the former Erie yard was designed to manufacture and practice).

*Primary Examiner*—Joseph F. Peters, Jr.
*Assistant Examiner*—Clifford T. Bartz
*Attorney, Agent, or Firm*—Cushman, Darby & Cushman

[57] ABSTRACT

Each longitudinally successive module of a longitudinally midbody for a tanker (which is preferably a double-walled tanker), is provided with a longitudinal vertical double-walled bulkhead extending between the top and bottom walls of the module. This longitudinal bulkhead may be provided on the longitudinal centerline of a tanker midbody constructed in accordance with the teachings of Cuneo et al., Ser. No. 07/532,329 and/or Goldbach et al. Ser. No. 07/678,802. Reinforcing structure for the longitudinal bulkhead is enclosed between the transversally opposite walls thereof. Within the longitudinal bulkhead, compartments may be provided for carrying fuel oil and/or cargo tanker slops and/or water ballast. The transversally opposite walls are fabricated of steel plates welded at adjacent edges. Inner plates transversally interconnect the walls at the joints between wall plates. The wall plates may be curved, which is preferred, or flat.

34 Claims, 7 Drawing Sheets

DOUBLE-HULLED VESSEL CONSTRUCTION HAVING VERTICAL DOUBLE-WALLED LONGITUDINAL BULKHEAD

BACKGROUND OF THE INVENTION

In the copending U.S. patent application of Cuneo et al., application Ser. No. 07/532,329, filed June 5, 1990, there is disclosed a method for constructing subassemblies for double-hulled vessel modules, laterally serially connecting the subassemblies to fabricate modules, longitudinally serially connecting the modules end to end to provide longitudinal midbodies for double-hulled vessels, and mounting bow and stern members to longitudinally opposite ends of the midbody to provide a double-hulled vessel, e.g., suitable for use as a very large crude carrier In the subassembly construction according to Cuneo et al., both the inner skin and the outer skin of the hull structure are fabricated of generally cylindrically arcuately curved steel plates. The two skins are interconnected at corresponding longitudinal joints between the respective curved plates, by welds at opposite edges of stiffened flat plates which extend thicknesswise of the vessel hull structure, thereby dividing the hull structure into a plurality of longitudinally extend tubular cells, preferably extending on the bottom, sidewalls and deck of the longitudinal midbody of the vessel In a preferred construction disclosed in Cuneo et al., each subassembly includes a generally straight wall portion and half of a corner, so that a perimetrically extending series of eight subassemblies may be assembled edge to edge, reversing alternate subassemblies so as to abut half-corners to half-corners and straight ends to straight ends, with the resulting transverse cross-sectional profile of a module being rounded-corner rectangular. At the longitudinal centerline plane of the longitudinal midbody of the Cuneo et al structure, each module may be provided with a cell that serves as a corresponding segment of hollow keel, for accommodating duct work, piping and the like. Each module, according to the Cuneo et al. application, preferably includes at one end a transverse bulkhead which fully obstructs that end of the module, being perimetrically welded to the inner skin of the module on both the fore and aft sides of the transverse bulkhead. Other than the transverse bulkheads, the double-hulled vessel midbody according to the Cuneo et al. application has no significant transversally extending structural elements. Accordingly, double-hulled VLCC's may be constructed substantially completely out of welded-together and painted plates of mild steel, with little constructional/operational cost disadvantage in comparison with single-hulled VLCC's of comparable crude-carrying capacity.

The more recent U.S patent application of Richard A. Goldbach et al., application Ser. No. 07/678,802, filed Apr. 1, 1991, discloses improved method for fabricating the subassemblies which, as one result have a protective paint coating which is more durable, yet lighter in weight, with corresponding improvements to the subassemblies, modules, longitudinal midbody and vessel.

In the application of Goldbach et al , an improved curved-plate, double-hull tanker construction is provided, having reduced or eliminated transverse reinforcing structure in its midbody, except for bulkheads. The hull, though double, can compare in weight to conventional single hulls, despite being entirely made of mild steel plate. It is made of significantly fewer pieces, with a reduction in welding footage More of the steel is used in the form of plate, rather than more expensive shapes. Improved productivity is possible, resulting from standardization of parts, less scrap, greater use of jigs and fixtures, automated welding, blast-cleaning and painting, so that not so much staging is needed, the work environment can be safer, and the product can be produced at a lower unit labor cost. Preferably, cathodic epoxy painting is used for durability and reduction in problems due to blast cleaning, solvent evaporation and generation of refuse. Extending the double hull structure from the bottom and sides of the hull to the main deck can provide space for fuel oil to be located safely away from the skin of the ship, rather than in possibly vulnerable deep tanks at the stern. The constructional technique is believed to be applicable to vessel hulls in the 70,000 DWT to 300,000 DWT range. The vessel hull midbody module subassemblies may be assembled into modules, hull midbodies and vessels using the method and apparatus disclosed in Cuneo et al., U.S. patent application Ser. No. 07/532,329.

Conventional double-hulled tankers typically have had either no longitudinal vertical centerline bulkhead at all, or, if they have had one, it has been only one plate thick. Also, in conventional double-hulled tankers, fuel oil tanks for the propulsion and power engines of the tanker itself, and cargo slop tanks have been located forward or aft of the cargo tank-providing midbody section of the tanker.

In instances where a single wall longitudinal vertical centerline bulkhead is conventionally provided, its major intended functions are to improve tanker stability (by reducing the free-surface effect of liquids in cargo tanks), to provide a barrier separating different liquid cargos, and, in some designs, to contribute longitudinal strength to the vessel.

Typically, additional bulkhead reinforcing structure must be provided if a conventional single wall longitudinal vertical centerline bulkhead is provided, and the presence of the additional reinforcing structure inside the cargo tanks makes cleaning the cargo tanks more difficult inasmuch as there is more surface area and more complex surface topography that needs to be cleaned.

SUMMARY OF THE INVENTION

Each longitudinally successive module of a longitudinal midbody for a tanker (which is preferably a double-walled tanker), is provided with a longitudinal vertical double-walled bulkhead extending between the top and bottom walls of the module. This longitudinal bulkhead may be provided on the longitudinal centerline of a tanker midbody constructed in accordance with the teachings of Cuneo et al., U.S. Pat. No. 07/532,329 and/or Goldbach et al., U.S. Pat. No. 07/678,802. Reinforcing structure for the longitudinal bulkhead is enclosed between the transversally opposite walls thereof Within the longitudinal bulkhead, compartments may be provided for carrying fuel oil and/or cargo tanker slops and/or water ballast. The transversally opposite walls are fabricated of steel plates welded at adjacent edges. Inner plates transversally interconnect the walls at the joints between wall plates. The wall plates may be curved, which is preferred, or flat.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
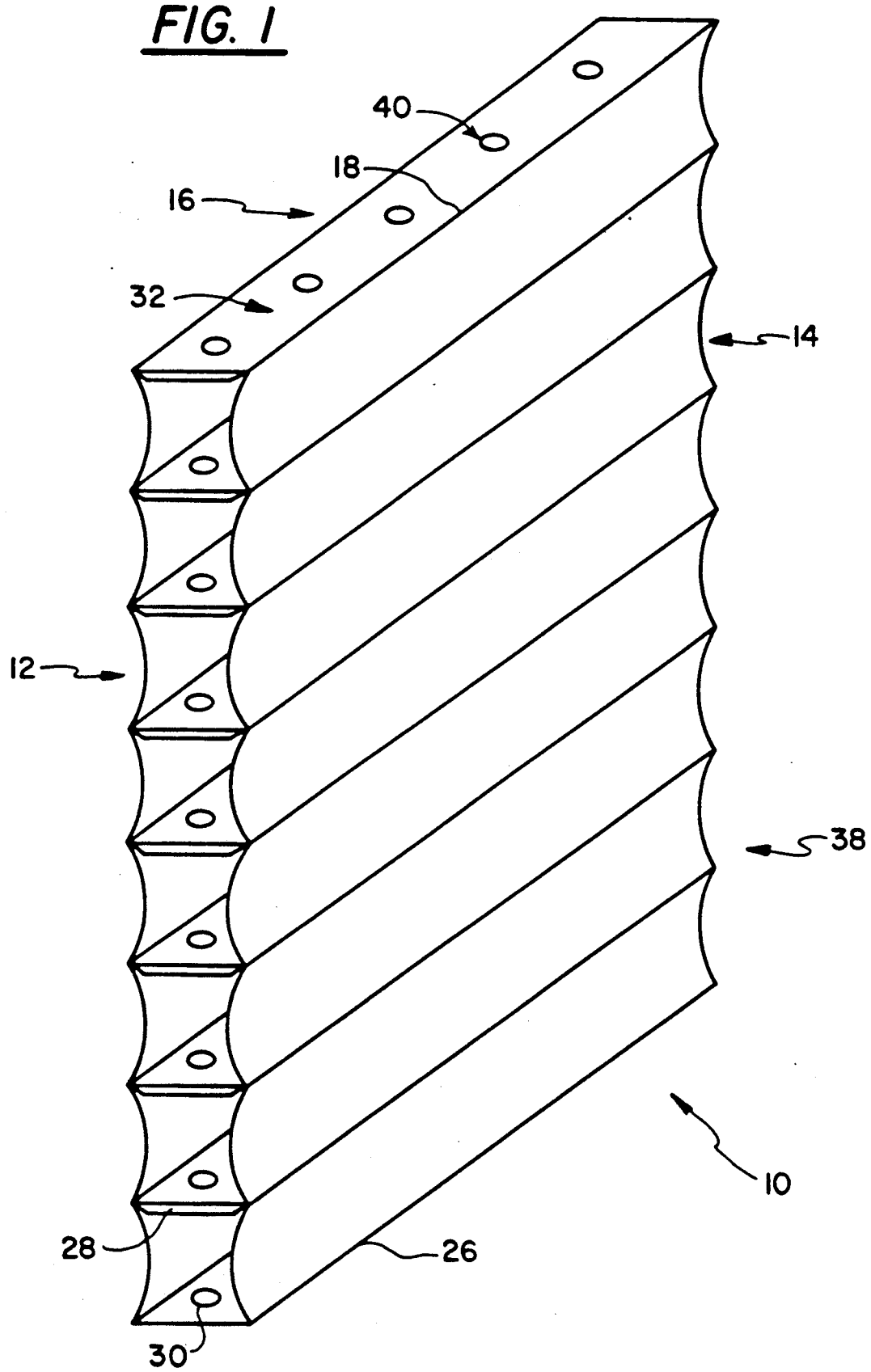
FIG. 1 is a perspective view of one module's worth of a longitudinal vertical bulkhead element embodying principles according to the present invention.

In FIG. 1, an embodiment of a double-walled longitudinal vertical bulkhead element embodying principles of the present invention is illustrated at 10. The bulkhead 10 is fabricated from a plurality of first (left) wall panels 12, a plurality of second (right) wall panels 14, and a plurality of stiffened flat panels 16.

The panels 12, 14 and 16 are preferably made of mild steel, in thicknesses and compositions typical of plating conventionally used for fabricating tanker hull skins and bulkheads. Each panel 12 and 14 is substantially elongated rectangular in elevation, so that it has two vertically opposite, longitudinally extending, relatively long side edges 18, two longitudinally opposite, vertically extending, relatively short end edges 20, and two laterally opposite faces 22, 24. For sake of ease of description, each wall face 22 which faces externally of the bulkhead element 10 will be referred to as an outer face, and each wall face 24 which faces internally of the bulkhead element 10 will be referred to as an inner face.

Similarly, each stiffened flat panel 16 comprises a flat plate panel 32 which is substantially elongated rectangular in plan, so that it has two laterally opposite, longitudinally extending, relatively long side edges 26, two longitudinally opposite, laterally extending, relatively short end edges 28, and two vertically opposite faces 30.

Each stiffened flat panel 16 further includes, welded on at least one of the faces 30 of the flat plate panel 32 thereof, a longitudinally extending series of transversally extending stiffener plates 34 each made of mild steel and welded on edge, e.g., along opposite side fillet welds 36, to the respective face 30. In instances where vertically adjoining cells 38 of the bulkhead element 10 are intended to interconnect, the flat plate panel 32 of the stiffened flat panel 16 which forms a common wall between them is provided, prior to fabrication of the bulkhead element 10, with at least one, and preferably a series of lightening holes 40 therethrough, interspersed between neighboring stiffener plates 34. The bulkhead element 10 may be manufactured by a method that is more thoroughly explained (with reference to many drawing figures) in the aforementioned copending U.S. patent applications of Cuneo et al. and Goldbach et al. (The two prior applications disclose methods for fabricating module subassemblies, connecting the subassemblies to provide modules, serially connecting the modules to provide a longitudinal midbody, and adding a bow section and an aft section at opposite ends of the midbody to provide a tanker.)

Each bulkhead element 10 of the present invention may be made in the same manner and by the same means as are described in the aforementioned Cuneo et al. and Goldbach et al. applications for manufacturing module subassemblies.

A description of such manufacture will be provided here, for the benefit of anyone not having convenient access to the disclosures in the aforementioned Cuneo et al. and Goldbach et al. applications.

For fabricating a bulkhead element 10, each curved plate panel 12, 14 and each stiffened flat plate panel 16 is provided with an all-over cured coating of paint (e.g., by using a known, available from P.P.G., cathodic epoxy water dispersion dip tank coating application process). A fixture (not shown) is provided as an array of upstanding towers on a foundation.

A first plurality of the painted curved plate panels 12 is vertically arranged in a first series in the fixture, in which individual ones of the panels 12 spacedly adjoin one another, side edge to side edge, with respective gaps between them, in a single layer.

A second plurality of the painted curved plate panels 14 is vertically arranged in a second series in the fixture, in which individual ones of the panels 14 spacedly adjoin one another, side edge to side edge, with respective gaps between them, in a single layer, so that gaps between panels 14 in the second series are substantially in registry with respective gaps between panels 12 in the first series, thicknesswise of the fixture.

A plurality of painted stiffened flat plate panels is vertically arranged in a series, in the fixture, so that one side edge 26 of each painted stiffened flat plate panel 16 adjoins a respective gap between side edges 18 in the first series of painted curved plate panels 12, and an opposite side edge 26 of each painted stiffened flat plate panel 16 adjoins a respective gap between side edges 18 in the second series of curved plate panels 14.

Figure 2:
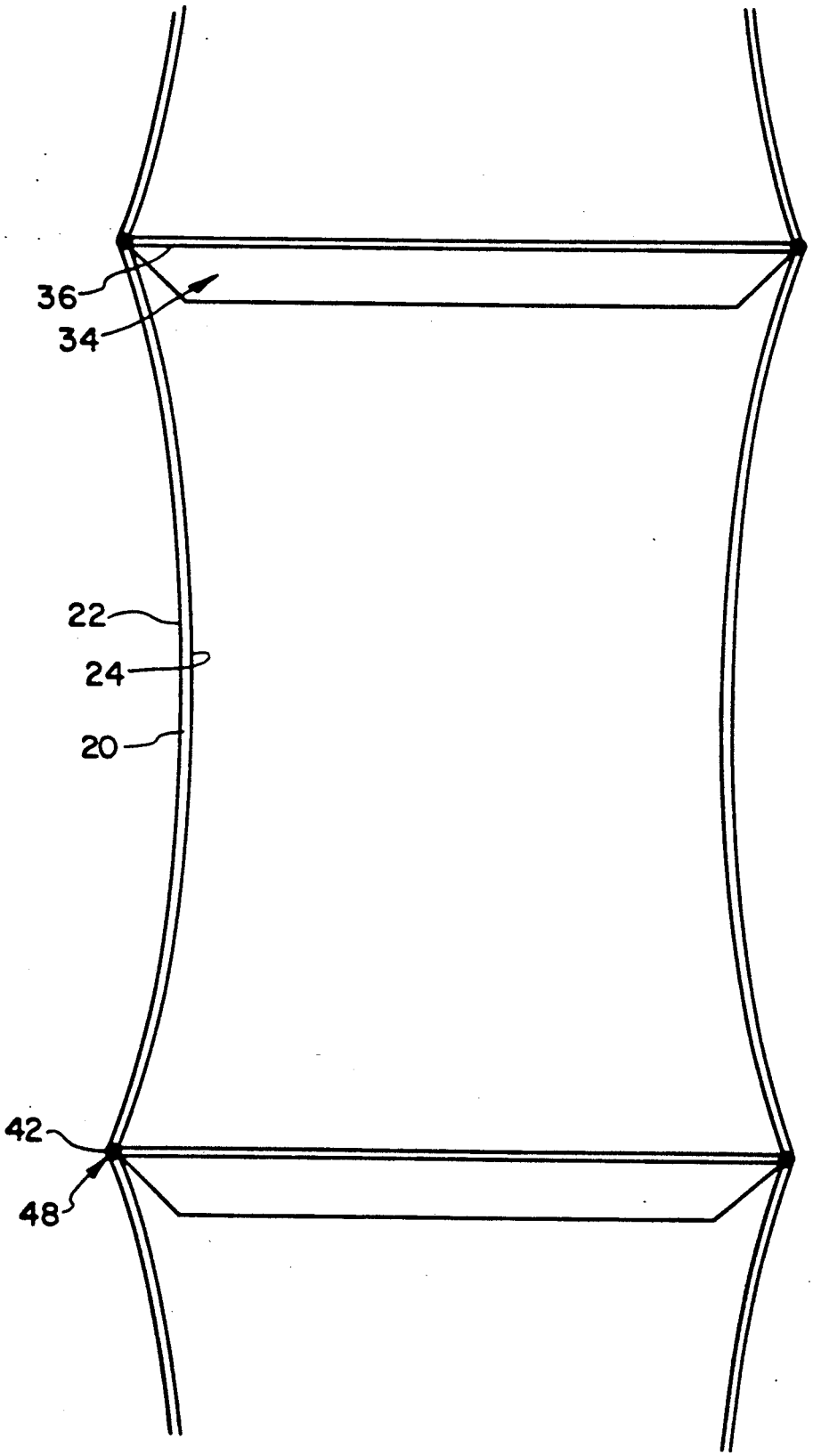
FIG. 2 is a larger scale fragmentary end view of the bulkhead element of FIG. 1 during manufacture, showing how the several panels are spacedly arranged edge-to-edge and united by welded seaming.

For the embodiment depicted in FIGS. 1 and 2, the arrangement of the curved plate panels 12, 14 in the fixture is such that the concave faces are the ones which face outwards.

While the panels 12, 14 and 16 are supported with respect to respective ones of the towers of the fixture, joints 42 are welded between and among respective ones of the panel side edges 18, 26 in respective ones of the gaps, thereby filling gaps and uniting the panels 12, 14 and 16 into a bulkhead element 10 having a plurality of longitudinally extending cells 38 of generally rectangular transverse cross-sectional shape. (The bulkhead element 10, in this embodiment, has two opposite ends 44, 46, where side edges 18 of respective terminal ones of the painted curved plate panels 12, 14 are available.) After the welding at 42 is completed (and preferably after touch-up exterior painting of the bulkhead element 10 along the margins of the welds 42, where heat and spatter have damaged the paint) support for the panels 12, 14, 16, from the fixture, is removed, and the bulkhead element 10 is lifted ut of the fixture. Damage to paint internally of the cells at the corners 48 is then repaired, so that the bulkhead element 10 has an all-over coating (preferably of epoxy paint).

As further described in the aforementioned applications of Cuneo et al. and Goldbach et al., substantially the same method is used for manufacturing double-walled hull subassemblies 50. Two transverse bulkhead elements 52 are provided side by side in a laid down flat orientation at a module assembly site (not shown).

A complement of double-walled hull subassemblies 50 is arranged terminal edge to terminal edge about the collective outer periphery 54 of the two bulkhead elements 52, and a bulkhead element 10 in the gap between spacedly adjacent medial edges 56 of the two transverse bulkhead elements 52. The opposite terminal side edges 58 of the longitudinal bulkhead element 10 respectively adjoin inner wall plate panels of the deck 62 and bottom portions of the arrangement of subassemblies 50 around the two transverse bulkhead elements 52.

Adjoining edges and surfaces of the assembled subassembly and transverse and longitudinal bulkhead elements are welded at joints 66 to provide a unitary module 68. As each module 68 is completed, it is tipped over onto its bottom, moved to an assembly site (not shown) for a longitudinal midbody 70, and longitudinally serially joined (by welding module end 72 to module end 72, including along end edges 20, 28 of panels at ends of longitudinal bulkhead elements 10, to provide a longitudinal midbody 70).

A conventional bow section 74 and a conventional stern section 76 may be conventionally mounted, e.g., by welding to opposite ends 78 of the longitudinal midbody, for providing a tanker having a plurality of cargo tanks 82. Functional elements 84 may be conventionally provided. Piping 86 may be provided for filling and emptying not only the cargo tanks 82, but also one or more cells or sets of cells 38 within the longitudinal bulkhead 88 which results from end-to-end connection of the elements 10, in order to provide tanks 90 for storage of fuel oil for powering the tanker 80, for cargo slops, and/or for water ballast.

Figure 3:
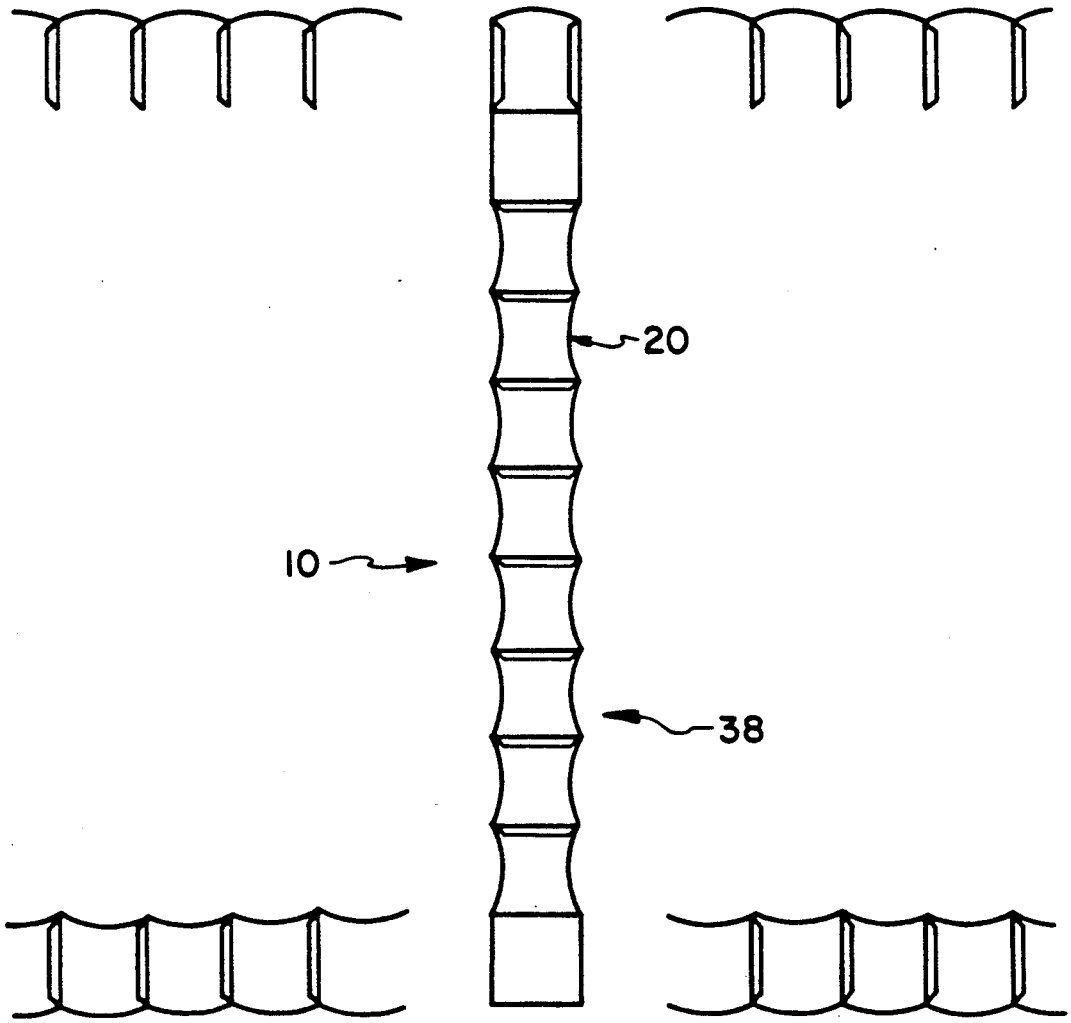
FIG. 3 is a view similar to FIG. 2, but of a modified form, in which elements of the deck and bottom are fabricated with the bulkhead as the bulkhead element is fabricated.

A second embodiment of the longitudinal bulkhead element of the present invention is shown in FIG. 3 at 110. It is different from the one depicted in FIGS. 1 and 2 only in that, as fabricated, the longitudinal bulkhead element 110 includes as terminal cells 192, 194 one which, when the longitudinal bulkhead element is arranged about transverse bulkhead elements and module subassemblies, generally as described above, will respectively become a cell of the double-walled deck and a cell (e.g., a box keel) of the double-walled bottom.

Figure 4:
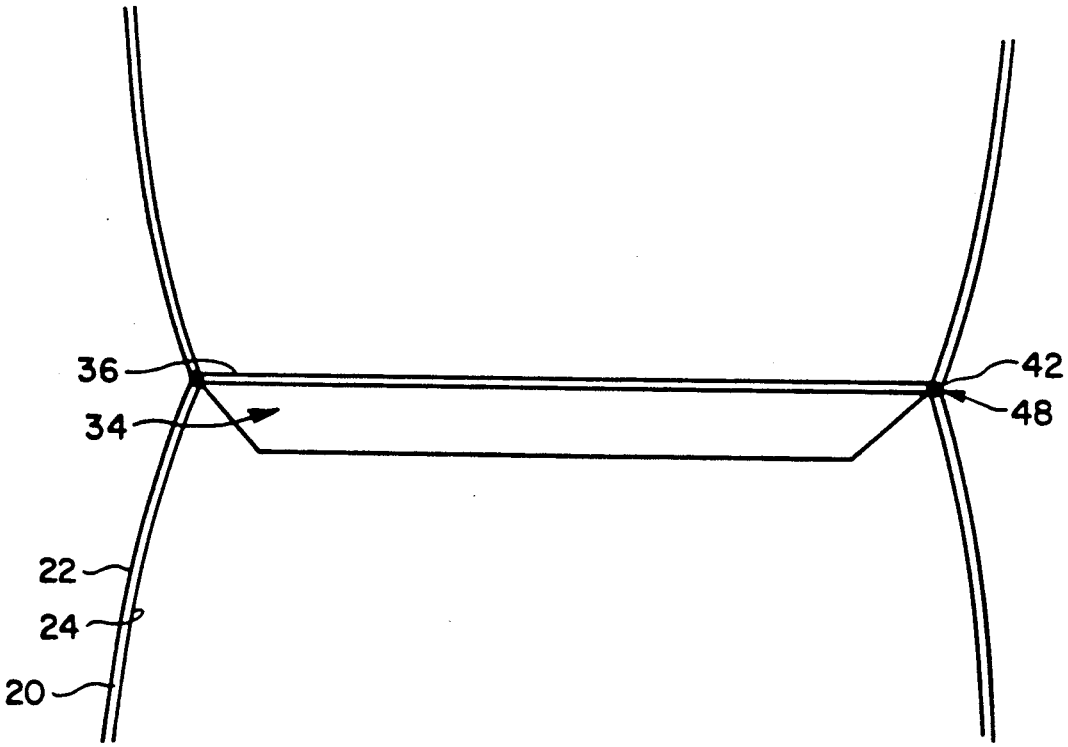
FIG. 4 is a view similar to FIG. 2, but of a modified form in which the wall panels are convex outwards rather than concave outwards.

A third embodiment of the longitudinal bulkhead element of the present invention is shown in FIG. 4 at 210. It is different from the one depicted in FIGS. 1 and 2 only in that, as the left and right curved wall panels 212, 214 are arranged in the fixture (not shown) for fabrication of the bulkhead element 210, their convex faces, rather than their concave faces face outwards and thus provide the outer faces of the bulkhead element 210.

Figure 5:
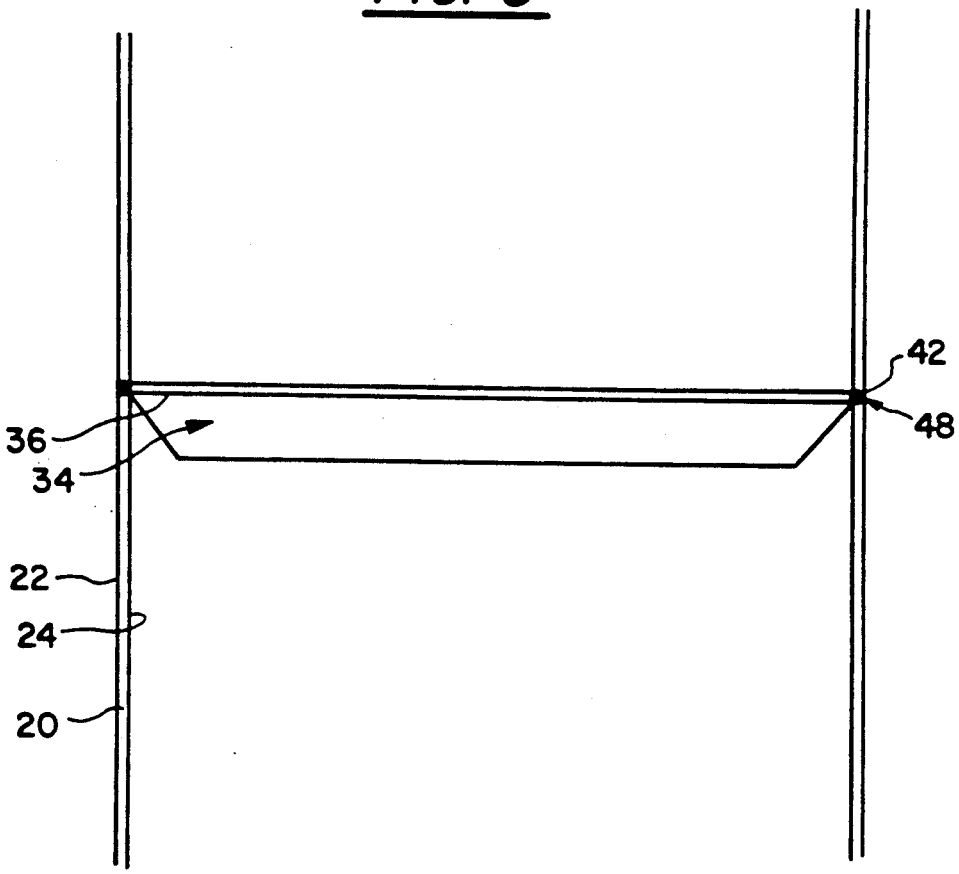
FIG. 5 is a view similar to FIG. 2, but of a modified form in which the wall panels are flat.

A fourth embodiment of the longitudinal bulkhead element of the present invention is shown in FIG. 5 at 310. It is different from the one depicted in FIGS. 1 and 2 only in that the left and right wall panels 312, 314 are flat, so that the corresponding left and right walls of the bulkhead element 310 are substantially flat.

Other permutations are possible within the concept of the invention, e.g., one side made of flat panels and the other of convex outwards panels, or one side made of flat panels and the other of concave outwards panels. Within the bulkhead element, depending on where and whether lightening openings are provided through the stiffened flat panels 16, all, some, or none of the cells are interconnected. Although cells preferably run uninterrupted for the full length of the tanker longitudinal midbody, transverse partition plates (not shown) can be provided (e.g., at the ends of respective ones of the modules) for dividing any cell into two or more compartments or tanks. Although in the instance depicted, the tanker longitudinal midbody is a plurality of modules 68 in length, it is within the concept of the invention that a tanker longitudinal midbody 70 could be only one module 68 in length (i.e., a module 68 could constitute a tanker longitudinal midbody 70). In a vessel incorporating such a longitudinal midbody, the transverse bulkhead elements might be omitted or each centrally open.

Although it is preferred that the longitudinal vertical bulkhead element be assembled to a module which itself has a double-hulled deck, bottom and sidewalls, in practice, the deck, bottom and/or sidewalls may be made of single thickness plate.

Figure 6:
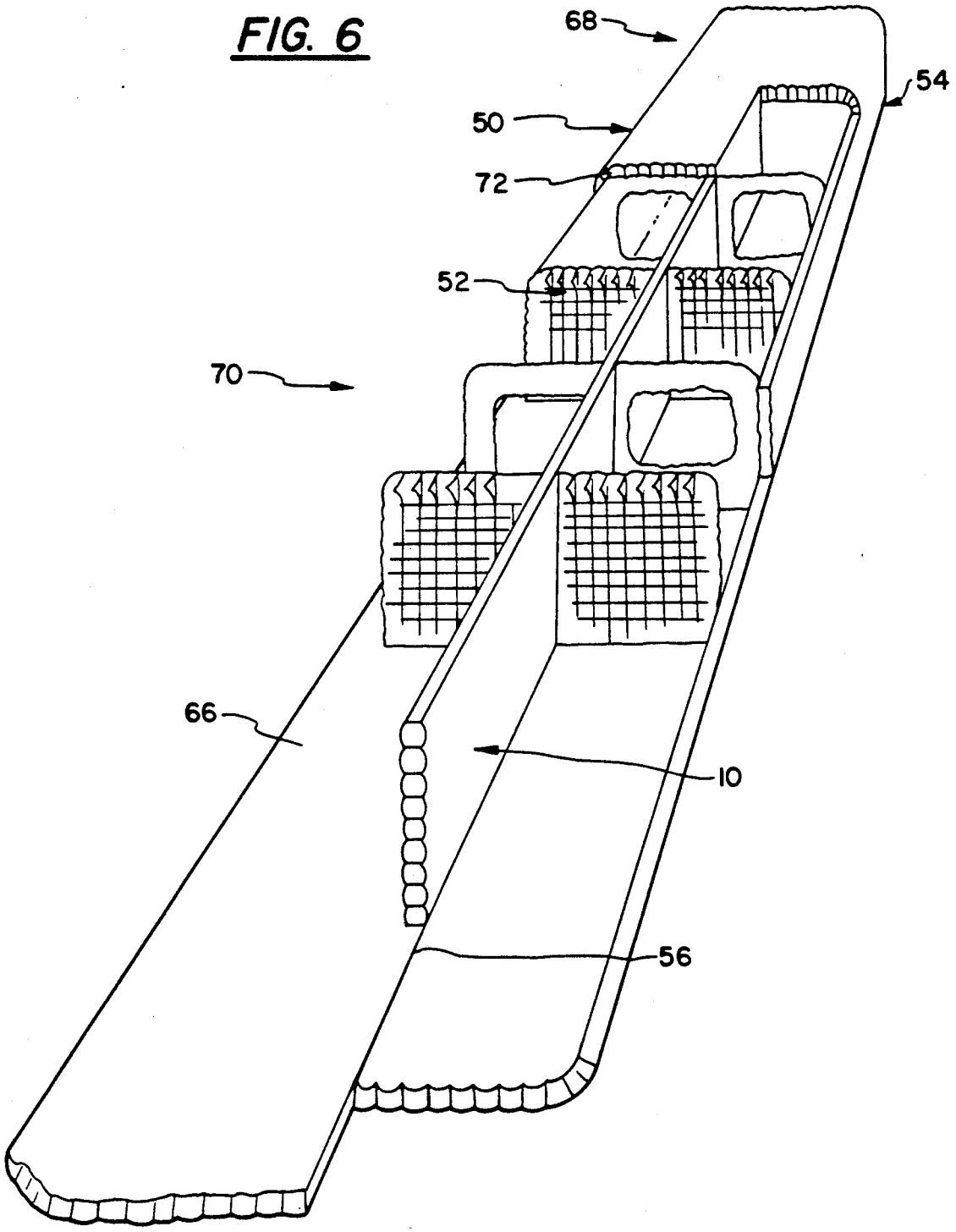
FIG. 6 is a cut-away perspective view of a tanker midbody made of modules provided with the longitudinal vertical bulkhead of the present invention.
Figure 7:
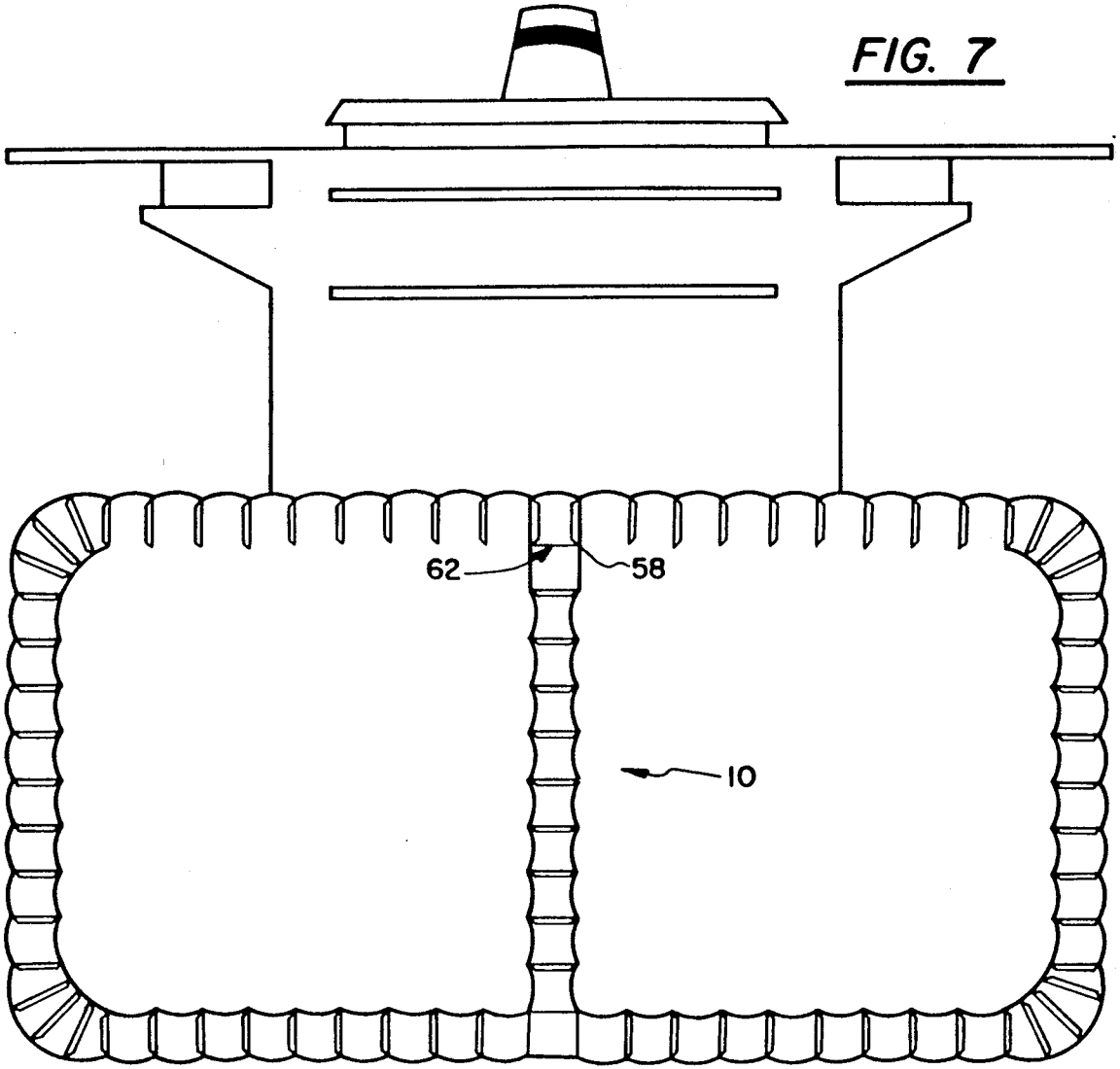
FIG. 7 is a transverse vertical sectional view of a double-hulled VLCC (very large crude carrier, a type of tanker) provided with the longitudinal vertical bulkhead of the present invention.
Figure 8:
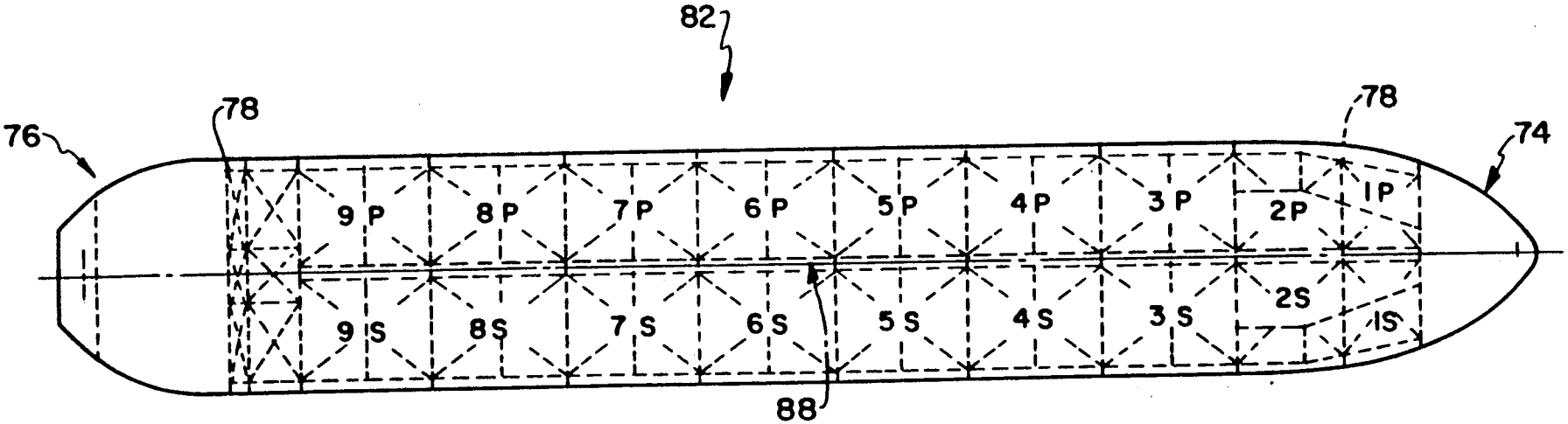
FIG. 8 is a somewhat diagrammatic cut-away longitudinal sectional view of a VLCC provided with the longitudinal vertical bulkhead of the present invention showing where different liquids are stored in the cargo tanks on opposite sides of the longitudinal bulkhead, and fuel oil, cargo slop and water ballast are carried in various internal cells of the longitudinal vertical bulkhead, piping for introducing and withdrawing the various liquids from the various compartments, tanks and cells.

In the instance depicted in FIG. 6, some of the transverse bulkheads are complete (i.e., blind) and others are ring-shaped (i.e., centrally open). In practice, alternatingly blind and centrally open bulkheads are preferred, looking lengthwise of the vessel, but any permutation from all blind to all centrally open may be used.

In practice, after welds have been made for connecting elements and subassemblies to make modules, for connecting modules to make a longitudinal midbody, and for connecting bow and stern sections to opposite ends of a longitudinal midbody to create a vessel, the joints and joint-bordering plate surfaces, both inside and outside of the cells are coated with protective coating (e.g., epoxy paint, that is thereafter cured), in order to protectively coat substantially all of the surfaces before the vessel is put into use. The preferred paint coating compositions and thicknesses are the same as those disclosed in the aforementioned U.S. application of Goldbach et al.

Although in the illustrated embodiment, each module has one longitudinal vertical bulkhead element with its cells running horizontally, lengthwise of the vessel, in a single vertical stack of cells bisected by the longitudinal vertical centerline plane of symmetry of the vessel, in practice, there may be two or more longitudinal vertical bulkhead elements placed side-by-side (i.e., double thickness, two cells wide), and/or there may be two, three or more of the longitudinal vertical bulkhead elements spaced from one another widthwise of the vessel, only one (or less than all) of which is located at the longitudinal midline of the vessel. For instance, there could be two side-by-side at the longitudinal midline, and two others, respectively, on opposite sides of the first two, halfway between the first two, and a respective sidewall of the vessel. In each case, the longitudinal vertical bulkheads are anchored into the deck and bottom of the vessel substantially as has been described above in relation to FIGS. 1 and 2, or as described above in relation to FIG. 3.

It should now be apparent that the double-hulled vessel construction having vertical double-walled longitudinal bulkhead as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A vessel construction having a double-walled longitudinal bulkhead element, comprising:

a plurality of flat plate panels, each being elongated rectangular in outer perimetrical shape so as to have two opposite side edges, two opposite end edges, and two opposite flat faces;

a longitudinally extending series of transversally extending stiffener plates mounted on one said face of each said flat plate panel, so as to provide a corresponding plurality of stiffened flat plate panels;

a first plurality of face plate panels, each being elongated rectangular in outer perimetrical shape, so as to have two opposite side edges, two opposite end edges, and two opposite faces, namely an inner face and an outer face;

a second plurality of face plate panels, each being elongated rectangular in outer perimetrical shape, so as to have two opposite side edges, two opposite end edges, and two opposite faces, namely an inner face and an outer face;

said first plurality of face plate panels being arranged in a first series, in which individual ones of these panels spacedly adjoin one another, side edge to side edge, with respective gaps between them, in a first single layer;

said second plurality of face plate panels being arranged in a second series, in which individual ones of these panels spacedly adjoin one another, side edge to side edge, with respective gaps between them, in a second single layer, so that gaps between panels in said first layer are substantially in registry with gaps between panels in said second layer, thicknesswise of said longitudinal bulkhead element;

said stiffened flat plate panels being arranged in a series, in which one side edge of each stiffened flat plate panel adjoins a respective gap in said first layer and an opposite edge thereof adjoins a respective gap in said second layer;

a plurality of welded joints, each filling respective ones of said gaps and thereby uniting respective ones of said panels into a double walled element having a plurality of longitudinally extending cells of generally rectangular transverse cross-sectional shape and two laterally opposite ends where side edges of respective terminal ones of said face plate panels in both of said layers are available for connection, respectively to a vessel deck element and a vessel bottom element for providing a vessel with a longitudinal bulkhead in which said cells are arranged in a vertically extending stack and each extends longitudinally of the vessel.

2. The double-walled longitudinal bulkhead element of claim 1, wherein:

said panels and said welded joints, both externally and internally of said cells are substantially completely coated with paint.

3. The double-walled longitudinal bulkhead element of claim 2, wherein:

said paint is a cured epoxy paint.

4. The double-walled longitudinal bulkhead element of claim 1, wherein:

each of said face plate panels is generally cylindrically arcuately curved so as to be concave outwards.

5. The double-walled longitudinal bulkhead element of claim 1, wherein:

each of said face plate panels is generally cylindrically arcuately curved so as to be convex outwards.

6. The double-walled longitudinal bulkhead element of claim 1, wherein:

all of the face plate panels in at least one of said layers are substantially flat.

7. The double-walled longitudinal bulkhead element of claim 1, wherein:

all of the face plate panels in both of said layers are substantially flat.

8. The double-walled longitudinal bulkhead element of claim 1, further including:

a portion of a vessel deck mounted to terminal ones of said face plate panels in both of said layers at an upper end of said double-walled longitudinal bulkhead element; and a portion of a vessel bottom mounted to terminal ones of said face plate panels in both of said layers at a lower end of said double-walled longitudinal bulkhead element.

9. The double-walled longitudinal bulkhead element of claim 8, wherein:

said vessel deck portion and said vessel bottom portion are respectively connected to respective said terminal ones of said face plate panels by respective welded joints.

10. A vessel construction having a double-walled longitudinal bulkhead element, said vessel construction comprising a module which includes a deck, a bottom, a left sidewall joining the deck and bottom, a right sidewall joining the deck and bottom; and, located intermediate and substantially parallel to said left and right sidewalls, a double-walled longitudinal bulkhead element;

said double-walled longitudinal bulkhead element comprising:

a plurality of flat plate panels, each being elongated rectangular in outer perimetrical shape so as to have two opposite side edges, two opposite end edges, and two opposite flat faces;

a longitudinally extending series of transversally extending stiffener plates mounted on one said face of each said flat plate panel, so as to provide a corresponding plurality of stiffened flat plate panels;

a first plurality of face plate panels, each being elongated rectangular in outer perimetrical shape, so as to have two opposite side edges, two opposite end edges, and two opposite faces, namely an inner face and an outer face;

a second plurality of face plate panels, each being elongated rectangular in outer perimetrical shape, so as to have two opposite side edges, two opposite end edges, and two opposite faces, namely an inner face and an outer face;

said first plurality of face plate panels being arranged in a first series, in which individual ones of these panels spacedly adjoin one another, side edge to side edge, with respective gaps between them, in a first single layer;

said second plurality of face plate panels being arranged in a second series, in which individual ones of these panels spacedly adjoin one another, side edge to side edge, with respective gaps between them, in a second single layer, so that gaps between panels in said first layer are substantially in registry with gaps between panels in said second layer, thicknesswise of said longitudinal bulkhead element;

said stiffened flat plate panels being arranged in a series, in which one side edge of each stiffened flat plate panel adjoins a respective gap in said first layer and an opposite edge thereof adjoins a respective gap in said second layer;

a plurality of welded joints, each filling respective ones of said gaps and thereby uniting respective ones of said panels into a double walled element having a plurality of longitudinally extending cells of generally rectangular transverse cross-sectional shape and two laterally opposite ends where side edges of respective terminal ones of said face plate panels in both of said layers are available for connection, respectively to a vessel deck element and a vessel bottom element for providing a vessel with a longitudinal bulkhead in which said cells are arranged in a vertically extending stack and each extends longitudinally of the vessel;

a portion of said deck being mounted to terminal ones of said face plate panels in both of said layers at an upper end of said double-walled longitudinal bulkhead element; and a portion of said bottom being mounted to terminal ones of said face plate panels in both of said layers at a lower end of said double-walled longitudinal bulkhead element.

11. The vessel construction of claim 10, wherein:

said vessel deck portion and said vessel bottom portion are respectively connected to respective said terminal ones of said face plate panels by respective welded joints.

12. The vessel construction of claim 11, wherein:

said bottom is a double-hulled bottom.

13. The vessel construction of claim 12, wherein:

said sidewalls are double-hulled sidewalls.

14. The vessel construction of claim 13, wherein:

said deck is a double-hulled deck.

15. The vessel construction of claim 11, wherein:

said module has a longitudinal vertical centerline plane of symmetry; and said double-walled longitudinal bulkhead element is substantially bisected by said plane.

16. The vessel construction of claim 11, further comprising:

two transverse bulkhead elements, each perimetrically surrounded by and weldingly joined with said deck, said bottom, and said longitudinal bulkhead element, respectively on laterally opposite sides of said longitudinal bulkhead element.

17. The vessel construction of claim 16, wherein:

both of said transverse bulkhead elements are blind.

18. The vessel construction of claim 17, wherein:

both of said transverse bulkhead elements are provided at one end of said module.

19. The vessel construction of claim 16, wherein:

both of said transverse bulkhead elements are ring-shaped and are thereby centrally open.

20. The vessel construction of claim 19, wherein:

both of said transverse bulkhead elements are provided at one end of said module.

21. A Vessel construction having a double-walled longitudinal bulkhead, said vessel construction comprising a series of modules connected end to end to provide a longitudinal midbody for a vessel, of which each said module includes a deck, a bottom, a left sidewall joining the deck and bottom, a right sidewall joining the deck and bottom; and, located intermediate and substantially parallel to said left and right sidewalls, a double-walled longitudinal bulkhead element;

said double-walled longitudinal bulkhead element comprising:

a plurality of flat plate panels, each being elongated rectangular in outer perimetrical shape so as to have two opposite side edges, two opposite end edges, and two opposite flat faces;

a longitudinally extending series of transversally extending stiffener plates mounted on one said face of each said flat plate panel, so as to provide a corresponding plurality of stiffened flat plate panels;

a first plurality of face plate panels, each being elongated rectangular in outer perimetrical shape, so as to have two opposite side edges, two opposite end edges, and two opposite faces, namely an inner face and an outer face;

a second plurality of face plate panels, each being elongated rectangular in outer perimetrical shape, so as to have two opposite side edges, two opposite end edges, and two opposite faces, namely an inner face and an outer face;

said first plurality of face plate panels being arranged in a first series, in which individual ones of these panels spacedly adjoin one another, side edge to side edge, with respective gaps between them, in a first single layer;

said second plurality of face plate panels being arranged in a second series, in which individual ones of these panels spacedly adjoin one another, side edge to side edge, with respective gaps between them, in a second single layer, so that gaps between panels in said first layer are substantially in registry with gaps between panels in said second layer, thicknesswise of said longitudinal bulkhead element;

said stiffened flat plate panels being arranged in a series, in which one side edge of each stiffened flat plate panel adjoins a respective gap in said first layer and an opposite edge thereof adjoins a respective gap in said second layer;

a plurality of welded joints, each filling respective ones of said gaps and thereby uniting respective ones of said panels into a double walled element having a plurality of longitudinally extending cells of generally rectangular transverse cross-sectional shape and two laterally opposite ends where side edges of respective terminal ones of said face plate panels in both of said layers are available for connection, respectively to a vessel deck element and a vessel bottom element for providing a vessel with a longitudinal bulkhead in which said cells are arranged in a vertically extending stack and each extends longitudinally of the vessel;

a portion of said deck being mounted to terminal ones of said face plate panels in both of said layers at an upper end of said double-walled longitudinal bulkhead element; and a portion of said bottom being mounted to terminal ones of said face plate panels in both of said layers at a lower end of said double-walled longitudinal bulkhead element;

said modules being connected end to end by respective welded joints to provide said longitudinal midbody.

22. The vessel construction of claim 21, wherein:

each module further comprises two transverse bulkhead elements, each perimetrically surrounded by and weldingly joined with said deck, said bottom, and said longitudinal bulkhead element, respectively on laterally opposite sides of said longitudinal bulkhead element.

23. The vessel construction of claim 22, wherein:

each module has a longitudinal vertical centerline plane of symmetry; and said double-walled longitudinal bulkhead element is substantially bisected by said plane.

24. The vessel construction of claim 23, wherein:

said bottom is a double-hulled bottom.

25. The vessel construction of claim 24, wherein:

said sidewalls are double-hulled sidewalls.

26. The vessel construction of claim 25, wherein:

said deck is a double-hulled deck.

27. The vessel construction of claim 21, wherein:

said longitudinal midbody has longitudinally opposite ends and said vessel construction further includes a vessel bow section connected to one end of said longitudinal midbody and a vessel stern section connected to the opposite end of said longitudinal midbody.

28. The vessel construction of claim 27, wherein:

said cells internally of said double-walled longitudinal bulkhead are isolated in a liquid-tight manner by said double-walled longitudinal bulkhead from cargo spaces defined within said vessel construction between said sidewalls, deck and bottom externally of said double-walled longitudinal bulkhead.

29. The vessel construction of claim 28, wherein each module further comprises:

two transverse bulkhead elements, each perimetrically surrounded by and weldingly joined with said deck, said bottom, and said longitudinal bulkhead element, respectively on laterally opposite sides of said longitudinal bulkhead element.

30. The vessel construction of claim 29, wherein:

at least some of said transverse bulkhead elements are blind and thereby divide said cargo space into a plurality of cargo tanks.

31. The vessel construction of claim 30, wherein:

each said module has a longitudinal vertical centerline plane of symmetry; and said double-walled longitudinal bulkhead element is substantially bisected by said plane.

32. The vessel construction of claim 31, wherein:

said bottom is a double-hulled bottom.

33. The vessel construction of claim 32, wherein:

said sidewalls are double-hulled sidewalls.

34. The vessel construction of claim 33, wherein:

said deck is a double-hulled deck.

* * * * *